US010049683B2

(12) United States Patent
Purnhagen et al.

(10) Patent No.: US 10,049,683 B2
(45) Date of Patent: Aug. 14, 2018

(54) AUDIO ENCODER AND DECODER

(71) Applicant: DOLBY INTERNATIONAL AB, Amsterdam Zuidoost (NL)

(72) Inventors: Heiko Purnhagen, Sundyberg (SE); Janusz Klejsa, Bromma (SE); Lars Villemoes, Jarfalla (SE); Toni Hirvonen, Stockholm (SE)

(73) Assignee: Dolby International AB, Amsterdam (NL)

( * ) Notice: Subject to any disclaimer, the term of this patent is extended or adjusted under 35 U.S.C. 154(b) by 0 days.

(21) Appl. No.: 15/030,327

(22) PCT Filed: Oct. 21, 2014

(86) PCT No.: PCT/EP2014/072571

§ 371 (c)(1),
(2) Date: Apr. 18, 2016

(87) PCT Pub. No.: WO2015/059154

PCT Pub. Date: Apr. 30, 2015

(65) Prior Publication Data

US 2016/0240206 A1 Aug. 18, 2016

Related U.S. Application Data

(60) Provisional application No. 61/973,653, filed on Apr. 1, 2014, provisional application No. 61/893,770, filed on Oct. 21, 2013.

(51) Int. Cl.
*H04R 5/00* (2006.01)
*G10L 19/20* (2013.01)
(Continued)

(52) U.S. Cl.
CPC ..... *G10L 19/20* (2013.01); *G10L 19/008* (2013.01); *G10L 19/06* (2013.01)

(58) Field of Classification Search
CPC . G10L 19/008; G10L 19/032; G10L 19/0204; G10L 19/06; G10L 19/26;
(Continued)

(56) References Cited

U.S. PATENT DOCUMENTS 7,602,183 B2 10/2009 Lustig
7,783,459 B2 8/2010 Rozell
(Continued)

FOREIGN PATENT DOCUMENTS

CN 103280221 9/2013
WO 2007/095516 8/2007
WO 2014/023443 2/2014

OTHER PUBLICATIONS

Neuendorf, M. et al "A Novel Scheme for Low Bitrate Unified Speech and Audio Coding—MPEG RMO" presented at the 126th Convention, Munich, Germany, May 7-10, 2009, pp. 1-13.
(Continued)

*Primary Examiner* — Alexander Jamal

(57) ABSTRACT

This disclosure falls into the field of audio coding, in particular it is related to the field of spatial audio coding, where the audio information is represented by multiple signals, where the signals may comprise audio channels or/and audio objects. In particular the disclosure provides a method and apparatus for reconstructing audio objects in an audio decoding system. Furthermore, this disclosure provides a method and apparatus for encoding such audio objects.

20 Claims, 5 Drawing Sheets

(51) Int. Cl.
*G10L 19/008* (2013.01)
*G10L 19/06* (2013.01)

(58) Field of Classification Search
CPC ..... H04S 2400/03; H04S 3/008; H04S 3/02; H04S 2420/03; H04S 2400/01
USPC ..... 381/22, 23; 704/500, 501
See application file for complete search history.

(56) References Cited

U.S. PATENT DOCUMENTS

| | | | | |
|---|---|---|---|---|
| 8,060,374 | B2 | 11/2011 | Pang | |
| 8,116,380 | B2 | 2/2012 | Regunathan | |
| 8,116,459 | B2 | 2/2012 | Disch | |
| 8,139,775 | B2 | 3/2012 | Hilpert | |
| 8,271,290 | B2 | 9/2012 | Breebaart | |
| 8,315,396 | B2 | 11/2012 | Schreiner | |
| 8,391,336 | B2 | 3/2013 | Chiskis | |
| 8,489,403 | B1 | 7/2013 | Griffin | |
| 8,571,877 | B2 | 10/2013 | Engdegard | |
| 8,582,659 | B2 | 11/2013 | Crinon | |
| 9,324,329 | B2 * | 4/2016 | Virette | G01L 9/008 |
| 2009/0006103 | A1 * | 1/2009 | Koishida | G10L 19/167 704/500 |
| 2010/0094631 | A1 * | 4/2010 | Engdegard | G10L 19/008 704/258 |
| 2010/0272191 | A1 | 10/2010 | Dorea | |
| 2011/0013790 | A1 * | 1/2011 | Hilpert | G10L 19/008 381/300 |
| 2011/0022402 | A1 * | 1/2011 | Engdegard | H04S 7/30 704/501 |
| 2011/0123192 | A1 | 5/2011 | Rosenthal | |
| 2011/0182432 | A1 | 7/2011 | Ishikawa | |
| 2012/0029926 | A1 | 2/2012 | Krishnan | |
| 2012/0144130 | A1 | 6/2012 | Fossum | |
| 2012/0188368 | A1 | 7/2012 | Shechtman | |
| 2012/0232910 | A1 | 9/2012 | Dressler | |
| 2012/0243692 | A1 | 9/2012 | Ramamoorthy | |
| 2012/0269353 | A1 | 10/2012 | Herre | |
| 2013/0070624 | A1 | 3/2013 | Nguyen | |
| 2014/0297296 | A1 * | 10/2014 | Koppens | G10L 19/008 704/500 |
| 2016/0111098 | A1 | 4/2016 | Samuelsson | |

OTHER PUBLICATIONS

Dorn, Thomas "Speicherung Schwach Besetzter Matrizen" Jan. 1, 1998, Section CRS-Format (auch CSR-Format).

Engdegard, J. et al "Spatial Audio Object Coding (SAOC)—The Upcoming MPEG Standard on Parametric Object Based Audio Coding" AES presented at the 124th Convention, May 17-20, 2008, Amsterdam, The Netherlands, pp. 1-15.

"Text File Formats" Matrix Market, Aug. 14, 2013,http://math.nist.gov/MatrixMarket/formats.html.

* cited by examiner

AUDIO ENCODER AND DECODER

CROSS-REFERENCE TO RELATED APPLICATIONS

This application claims priority from U.S. Provisional Patent Application Nos. 61/893,770 filed on 21 Oct. 2013 and 61/973,653 filed 1 Apr. 2014, which is hereby incorporated by reference in its entirety.

TECHNICAL FIELD

This disclosure falls into the field of audio coding, in particular it is related to the field of spatial audio coding, where the audio information is represented by multiple signals, where the signals may comprise audio channels or/and audio objects. In particular the disclosure provides a method and apparatus for reconstructing audio objects in an audio decoding system. Furthermore, this disclosure provides a method and apparatus for encoding such audio objects.

BACKGROUND ART

In conventional audio systems, a channel-based approach is employed. Each channel may for example represent the content of one speaker or one speaker array. Possible coding schemes for such systems include discrete multi-channel coding or parametric coding such as MPEG Surround.

More recently, a new approach has been developed. This approach is object-based, which may be advantageous when coding complex audio scenes, for example in cinema applications. In system employing the object-based approach, a three-dimensional audio scene is represented by audio objects with their associated metadata (for instance, positional metadata). These audio objects move around in the three-dimensional audio scene during playback of the audio signal. The system may further include so called bed channels, which may be described as signals which are directly mapped to certain output channels of for example a conventional audio system as described above.

A problem that may arise in an object-based audio system is how to efficiently encode and decode the object audio signals and preserve the quality of the coded signal. A possible coding scheme includes, on an encoder side, means for creating a downmix signal comprising a number of channels derived from the audio objects and bed channels, and means for generating side information which facilitates reconstruction of the audio objects and bed channels on a decoder side.

MPEG Spatial Audio Object Coding (MPEG SAOC) describes a system for parametric coding of audio objects. The system sends side information, i.e. an upmix matrix, describing the properties of the objects by means of parameters such as level difference and cross correlation of the objects. These parameters are then used to control the reconstruction of the audio objects on a decoder side. This process can be mathematically complex and often has to rely on assumptions about properties of the audio objects that are not explicitly described by the parameters. The method presented in MPEG SAOC may lower the required bit rate for an object-based audio system, but further improvements may be needed to further increase the efficiency and quality as described above.

BRIEF DESCRIPTION OF THE DRAWINGS

Example embodiments will now be described with reference to the accompanying drawings, on which.

All the figures are schematic and generally only show parts which are necessary in order to elucidate the disclosure, whereas other parts may be omitted or merely suggested. Unless otherwise indicated, like reference numerals refer to like parts in different figures.

DETAILED DESCRIPTION

Figure 1:
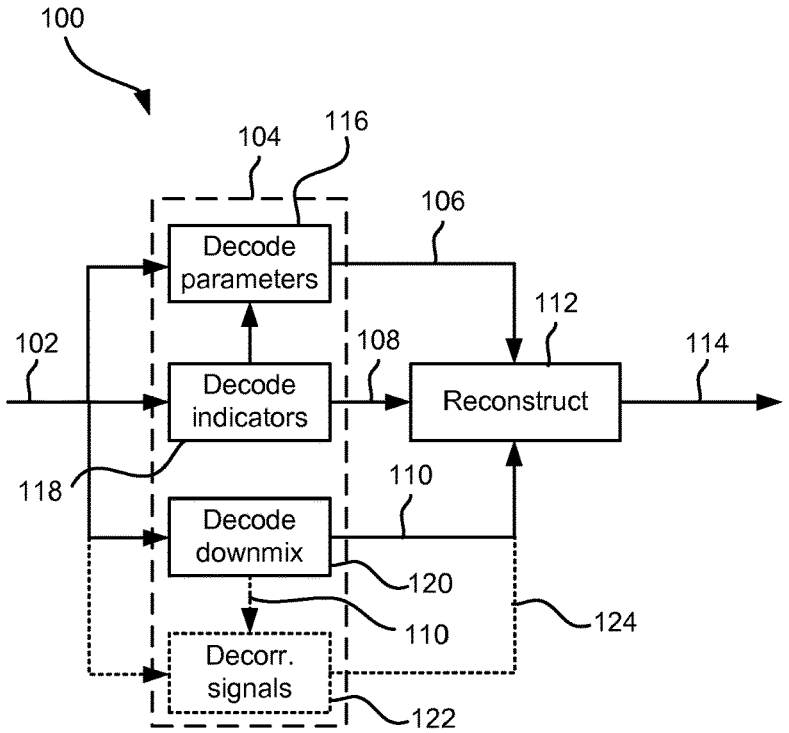
FIG. 1 is a generalized block diagram of a decoder for reconstructing an audio object in accordance with exemplary embodiments, FIG. 2 describes decoding of an upmix matrix according to a first decoding mode, FIG. 3 describes decoding of an upmix matrix according to the first decoding mode, FIG. 4 describes decoding of an upmix matrix according to a second decoding mode, FIG. 5 describes a method for reconstructing an audio object in a time frame comprising a plurality of frequency bands, FIG. 6, describes method for encoding an audio object in a time frame comprising a plurality of frequency bands, the method having a first and a second encoding mode.

In view of the above, the objective is to provide encoders and decoders and associated methods aiming at optimizing the trade-off between coding efficacy and reconstruction quality of the coded audio objects.

I. Overview—Decoder

According to a first aspect, example embodiments propose decoding methods, decoders, and computer program products for decoding. The proposed methods, decoders and computer program products may generally have the same features and advantages.

According to example embodiments there is provided a method for reconstructing an audio object in a time frame comprising a plurality of frequency bands. The method comprises the steps of: receiving M>1 downmix signals, each being a combination of a plurality of audio objects including the audio object, and receiving indicators comprising first indicators that indicate which of the M downmix signals to be used in the plurality of frequency bands when reconstructing the audio object. In a first decoding mode, each of the first indicators indicates a downmix signal to be used for all of the plurality of frequency bands when reconstructing the audio object. The method further comprises the steps of: receiving first parameters each associated with a frequency band and a downmix signal indicated by the first indicators for that frequency band, and reconstructing the audio object in the plurality of frequency bands by forming a weighted sum of at least the downmix signals indicated by the first indicators for that frequency band, wherein each downmix signal is weighted according to its associated first parameter.

An advantage of this method is that the bit rate required for transmitting the parameters for reconstrucing the audio object from at least the M downmix signals is reduced, since only the parameters for the downmix signals indicated by the indicators needs to be received by a decoder implementing the method. A further advantage of this method is that the complexity of reconstructing the audio object may be reduced since the indicators indicate what parameters that are used for reconstruction in any given time frame. Consequently, unnecessary multiplications by zero may be avoided. An advantage of using only one indicator for indicating that a downmix signal should be used for all of the plurality of frequency bands when reconstructing the audio object is that the required bit rate for transmitting the indicators may be reduced.

According to embodiments, the method further comprises the step of: forming K≥1 decorrelated signals, wherein the indicators further comprising second indicators which indicate which of the K decorrelated signals to be used in the plurality of frequency bands when reconstructing the audio object. In the first decoding mode, each of the second indicators indicates a decorrelated signal to be used for all of the plurality of frequency bands when reconstructing the audio object. The method further comprises the step of: receiving second parameters each associated with a frequency band and a decorrelated signal indicated by the second indicators for that frequency band. The step of reconstructing the audio object in the plurality of frequency band further comprises adding to the weighted sum of the downmix signals for a particular frequency band, a weighted sum of the decorrelated signals indicated by the second indicators for that particular frequency band, wherein each decorrelated signal is weighted according to its associated second parameter.

By using decorrelated signals when reconstructing the audio object, any unwanted correlation between reconstructed audio objects may be reduced.

According to embodiments, the indicators are received in the form of a binary vector, each element of the binary vector corresponding to one of the M downmix signals or K decorrelated signals, if applicable.

An advantage of receiving the indicators in the form of a binary vector is that a simple conversion from data received in the form of a bit stream may be provided.

According to embodiments, the received binary vector is coded by entropy coding. This may further reduce the required bit rate for transmitting the indicators.

According to embodiments, the method comprises a second decoding mode. In the second decoding mode, the indicators for each frequency band indicate a single one of the M downmix signals or K decorrelated signals, if applicable, to be used in that frequency band when reconstructing the audio object. This decoding mode may lead to a reduction of the required bit rate for transmitting the parameters since only a single parameter needs to be transmitted for each frequency band of the audio object to be reconstructed.

According to embodiments, the indicators are received in the form of a vector of integers, wherein each element in the vector of integers corresponds to a frequency band and the index of the single downmix signal to be used for that frequency band. This may be an efficient way of indicating what downmix signal should be used for a specific frequency band. A vector of integers may further facilitate efficient coding of the indicators in a bit stream received by the decoder. The received integer vector may according to embodiments be coded by entropy coding.

According to embodiments, the method further comprises the step of receiving a decoding mode parameter indicating which of the first decoding mode and the second decoding mode to be used. This may reduce the decoding complexity since no calculation of what decoding mode should be used may be necessary.

According to embodiments, the indicators are received separately from the parameters. The decoder implementing the disclosed method may first reconstruct an indicator matrix which indicates which downmix signals and decorrelated signals, if applicable, should be used when reconstructing the audio object. The indicator matrix indicates the parameters which are received in a bit stream received by the decoder. This may allow for a generic implementation of the reconstruction step of the method, independently of what decoding mode that is used. By receiving the indicators separately, before the parameters, no buffering of the parameters may be necessary.

According to embodiments, at least some of the received first parameters and second parameters, if applicable, are coded by means of time differential coding and/or frequency differential coding. The first and second parameters, if applicable, may be coded by means of entropy coding. An advantage of coding the parameters using time differential coding and/or frequency differential coding and/or entropy coding may be that the bit rate required for transmitting the parameters for reconstrucing the audio object is reduced According to example embodiments there is provided a computer-readable medium comprising computer code instructions adapted to carry out any method of the first aspect when executed on a device having processing capability.

According to example embodiments there is provided a decoder for reconstructing an audio object in a time frame comprising a plurality of frequency bands, comprising: a receiving stage configured for: receiving M>1 downmix signals, each being a combination of a plurality of audio objects including the audio object, receiving indicators comprising first indicators that indicate which of the M downmix signals to be used in the plurality of frequency bands when reconstructing the audio object, wherein, in a first decoding mode, each of the first indicators indicates a downmix signal to be used for all of the plurality of frequency bands when reconstructing the audio object, and receiving first parameters each associated with a frequency band and a downmix signal indicated by the indicators for that frequency band. The decoder further comprises a reconstruction stage configured for reconstructing the audio object in the plurality of frequency bands by forming a weighted sum of the downmix signals indicated by the first indicators for that frequency band, wherein each downmix signal is weighted according to its associated first parameter.

II. Overview—Encoder

According to a second aspect, example embodiments propose encoding methods, encoders, and computer program products for encoding. The proposed methods, encoders and computer program products may generally have the same features and advantages. Generally, features of the second aspect may have the same advantages as corresponding features of the first aspect.

According to example embodiments, a method for encoding an audio object is provided herein. The object is represented by a time frame comprising a plurality of frequency bands. The method comprises the step of: determining M>1 downmix signals, each being a combination of a plurality of audio objects including the audio object. In a first encoding mode, the method comprises the steps of selecting a subset of the M downmix signals to be used when reconstructing the audio object in a decoder in a audio coding system, and representing each downmix signal in the subset of the M downmix signals by an indicator identifying the downmix signal among the M downmix signals, and by a plurality of parameters, one for each of the plurality of frequency bands, and each one associated with a frequency band, wherein each parameter of the plurality of parameters represents a weight for the downmix signal when reconstructing the audio object for the associated frequency band.

According to example embodiments, the method, in the first encoding mode, further comprising the steps of selecting a subset of the K decorrelated signals to be used when reconstructing the audio object in a decoder in an audio coding system, and representing each decorrelated signal in the subset of the K decorrelated signals by an indicator identifying the decorrelated signal among the K decorrelated signals, and by a plurality of parameters, one for each of the plurality of frequency bands, and each one associated with a frequency band, wherein each parameter of the plurality of parameters represents a weight for the decorrelated signal when reconstructing the audio object for the associated frequency band.

According to example embodiments, the method comprises a second encoding mode. In this mode, the method further comprises the step of, for each of the plurality of frequency band, selecting a single one of the M downmix signals or K decorrelated signals, if applicable, and representing the selected signal by an indicator identifying the selected signal among the M downmix signals and K decorrelated signals, if applicable, and by and a parameter representing a weight for the selected signal when reconstructing the audio object for the frequency band.

By having a plurality of different encoding modes, depending on the content of the audio object to be reconstructed, and depending on available bit rate for transmitting the parameters and the indicators, a currently best coding mode may be chosen by an encoder. When using one of the first and the second encoding mode, the used encoding mode may be indicated by a decoding mode parameter included in a data stream for transmittal to the decoder.

According to example embodiments, the indicators identifying downmix signals or decorrelated signals, if applicable, are included in a data stream for transmittal to the decoder separately from the parameters representing weights for the downmix signals or decorrelated signals, if applicable.

When the encoder may choose between different encoding modes when encoding an audio object, it is advantageous to include the indicators in the bit stream separately from the parameters since this may facilitate that a generic decoder which can decode the encoded audio object no matter what encoding mode that is used.

According to example embodiments there is provided a computer-readable medium comprising computer code instructions adapted to carry out any method of the second aspect when executed on a device having processing capability.

According to example embodiments there is provided an encoder for encoding an audio object in a time frame comprising a plurality of frequency bands, comprising: a downmix determining stage configured for determining M>1 downmix signals, each being a combination of a plurality of audio objects including the audio object, a coding stage configure for, in a first encoding mode, selecting a subset of the M downmix signals to be used when reconstructing the audio object in a decoder in a audio coding system, and representing each downmix signal in the subset of the M downmix signals by an indicator identifying the downmix signal among the M downmix signals, and by a plurality of parameters, one for each of the plurality of frequency bands, and each one associated with a frequency band, wherein each parameter of the plurality of parameters represents a weight for the downmix signal when reconstructing the audio object for the associated frequency band.

III. Example Embodiments

The specifics of the reconstruction of an audio objects (or channels) will now be described.

In the following it is assumed that there are N original audio signals x which can be either objects or channels.

$$x_n(t), n=1, \ldots, N,$$

These are reconstructed from M downmix signals y $$y_m(t), m=1, \ldots, M.$$

where the time variable t belongs to a time segment or a time-frequency tile. It is convenient to think of the signals as row vectors and collect them in matrices X and Y. A reconstruction matrix (or upmix matrix) $C_f$ for the downmix signals of size N×M and a reconstruction matrix (or upmix matrix) $P_f$ for decorrelated signals of size N×K (K being the number of decorrelated signals) are used to create the output according to $$\hat{x}_n(t)=\Sigma_m c_{nm} y_m(t)+\Sigma_z p_{nk} z_k(t) \quad \text{equation (1)}$$

where $z_k(t)$, k=1, . . . , K are outputs from a decorrelation process and where $\hat{x}_n(t)$ denotes the reconstructed audio object for a certain time segment. In matrix notation, taking a single time-frequency tile, we have $$\hat{X}(t,f)=C_f(t)Y(t,f)+P_f(t)Z(t,f) \quad \text{Equation (2)}$$

The matrices $C_f$ and $P_f$ are typically estimated for time-frequency tiles and represent the decoded upmix matrixes to use when reconstructing the audio object(s) from the downmix signals and the decorrelated signals, respectively. In this case, the subscript f may correspond to a frequency tile. The reconstruction of $C_f$ and $P_f$ will be specified below. A typical update interval in time would be for example 23.4375 Hz (i.e. 48 kHz/2048 samples). The frequency resolution could be between 7 and 12 bands spanning the full-band. Typically the frequency partition is non-uniform and it is optimized on perceptual grounds. The desired time-frequency resolution can be obtained by means of a time-frequency transformation or by a filterbank, for instance, by using QMF.

Audio encoding/decoding systems typically divide the time-frequency space into time/frequency tiles, e.g. by applying suitable filter banks to the input audio signals. By a time/frequency tile is generally meant a portion of the time-frequency space corresponding to a time interval and a frequency band. The time interval may typically correspond to the duration of a time frame used in the audio encoding/decoding system. The frequency band is a part of the entire frequency range of the whole frequency range of the audio signal/object that is being encoded or decoded. The frequency band may typically correspond to one or several neighbouring frequency bands defined by a filter bank used in the encoding/decoding system. In the case the frequency band corresponds to several neighbouring frequency bands defined by the filter bank, this allows for having non-uniform frequency bands in the decoding process of the audio signal, for example wider frequency bands for higher frequencies of the audio signal.

It may be noted that the decorrelated signals, and thus the upmix matrix P may not be needed in some cases, although, in a general case, it is beneficial to use them, in particular, while operating at low bit-rates.

This disclosure deals with transmission of the data in C (and P) to the decoder by reducing the associated bit-rate cost. The reduction of the bit-rate cost is achieved by imposing and exploiting sparsity of the parameter data within the matrices C and P. The exploitation of the sparse stricture of the parametric data is achieved by design of efficient bit stream syntax. In particular, the syntax design takes into account that the matrices C and P may be sparse and thus advantageously the encoder may employ sparse coding and thus sparsify the matrices at the encoder and utilize the knowledge about the sparsification strategy to produce a compact bit-stream.

FIG. 1 shows a generalized block diagram of a decoder 100 in an audio coding system for reconstructing an audio object from a bit stream 102. The decoder 100 comprises a receiving stage 104 which in turn comprises three substages 116, 118, 120 configured for receiving and decoding the bit stream 102. The substage 120 is configured for receiving and decoding M>1 downmix signals 110. In general, each of the M downmix signals 110 is determined from a plurality of audio objects including the audio object to be reconstructed. For example, each of the M downmix signals 110 may be a linear combination of the plurality of audio objects. The substage 118 is configured for receiving and decoding indicators 108 comprising first indicators that indicate which of the M downmix signals to be used in the plurality of frequency bands when reconstructing the audio object 114. The substage 116 is configured for receiving and decoding first parameters 106 each associated with a frequency band and a downmix signal indicated by the indicators for that frequency band. In a first decoding mode, each of the first indicators indicates a downmix to be used for all of the plurality of frequency bands when reconstructing the audio object. This decoding mode will now be explained in further detail in conjunction with FIG. 2.

Figure 2:
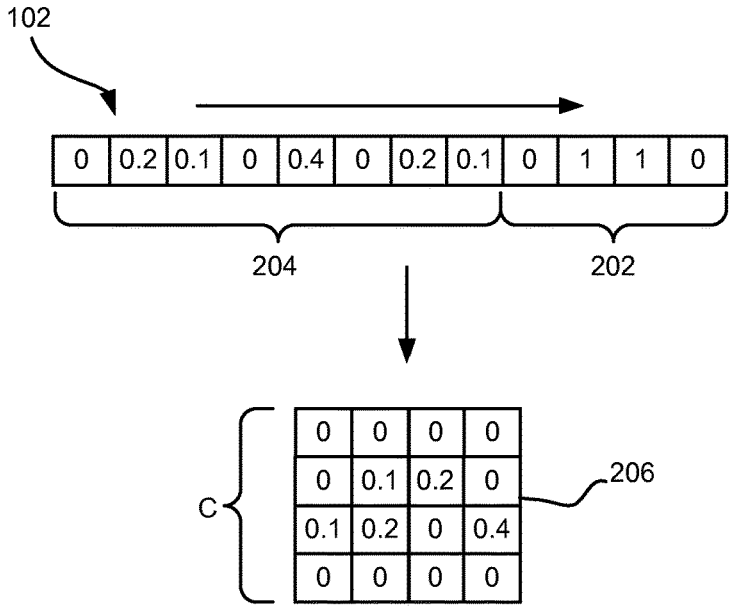

In FIG. 2, parts of the bit stream 102 is depicted. The bit stream is received by the encoder such the right most value in the bit stream is received first and the left most value is received last, also indicated by the arrow depicted above the representation of the bit stream. The bit stream 102 comprises a part 202 comprising four indicators that indicate which of the M downmix signals (not shown in FIG. 2), in this case M=4, to be used in the plurality of frequency bands when reconstructing the audio object. It may be noted that M=4 may be specific for this time frame, for other time frames, M may be larger or smaller. The indicators 202 may be received in the form of a binary vector. The bit stream 102 further comprises parameters 204 which each are associated with a frequency band and a downmix signal indicated by the indicators for that frequency band. For the ease of explaining the first decoding mode, in FIG. 2 a complete upmix matrix 206 for the audio object is reconstructed, which is a matrix of reconstruction parameters (in FIG. 2, only the first parameters, each associated with a frequency band and a downmix signal indicated by the first indicators for that frequency band, are used), for the audio object, where the columns correspond to frequency bands, and rows correspond to downmix signals. One may notice that the two rows associated with zeroes in the first indicators 202 consist only from zeroes, which means that the associated downmix signals are not used when reconstructing the object. In some embodiments of the encoder 100 the complete upmix matrix 206 is reconstructed, in other embodiments, the reconstruction stage 112 in FIG. 1 of the decoder may just assume that any not indicated downmix signal is not used when reconstructing the audio object and according to this embodiment, the complete upmix matrix needs not to be fully reconstructed.

The decoder determines if the first decoding mode should be used from the bit stream. The decoder further determines how many frequency bands this particular time frame includes. The number of frequency bands may be indicated in the bit stream 102 or transmitted from an encoder in the audio coding system to the decoder 100 in any other suitable way (e.g. a predefined value bay be used). With this knowledge, the upmix matrix 206 is decoded. For example, the first value among the indicators 202 indicate that the first of the M downmix signals should not be used for this particular audio object in this particular time frame. The second value among the indicators 202 indicate that the second of the M downmix signals should be used. The third indicator indicate that the third downmix signal should also be used while the fourth indicator tells the decoder 100 that the fourth downmix signal should not be used. Once the indicators are determined at the decoder, the parameters can be decoded. Since the decoder knows the number of frequency bands, e.g. four in this case, it knows that the first four parameters each are associated with subsequent frequency bands and the second downmix signal. Likewise it knows that the next four parameters each are associated with subsequent frequency bands and the third downmix signal. Consequently, the upmix matrix 206 is reconstructed. This upmix matrix (also denoted C) is then used by the reconstruction stage 112 for reconstructing the audio object. The reconstruction stage is configured for reconstructing the audio object in the plurality of frequency bands by forming a weighted sum of at least the downmix signals indicated by the first indicators for that frequency band, wherein each downmix signal is weighted according to its associated first parameter. In other words, the reconstruction stage may be configured to, for each frequency band indicated by the first indicators, forming a weighted sum of at least the downmix signals indicated by the first indicators for that frequency band, wherein each downmix signal is weighted according to its associated first parameter and thereby reconstructing the audio object. The specifics of the reconstruction are described above in conjunction with the equations (1) and (2).

The receiving stage 104 of the decoder 100 may according to some embodiments comprise a substage 122 which is configured for forming K>=1 decorrelated signals 124. The decorrelated signals may be based on a subset of the M downmix signals 110 and decorrelation parameters received from the bit stream 102. The decorrelated signals may also be formed based on any other signal available to the receiving stage such as for example a bed signal or channel. According to this embodiment, the received and decoded indicators 108 comprises further comprises second indicators which indicate which of the K decorrelated signals to be used in the plurality of frequency bands when reconstructing the audio object 114. The received and decoded parameters 106 may further comprise second parameters, each associated with a frequency band and a decorrelated signal indicated by the second indicators for that frequency band. According to the first decoding mode, each of the second indicators indicates a decorrelated signal 124 to be used for all of the plurality of frequency bands when reconstructing the audio object 114. This is further explained in conjunction with FIG. 3.

Figure 3:
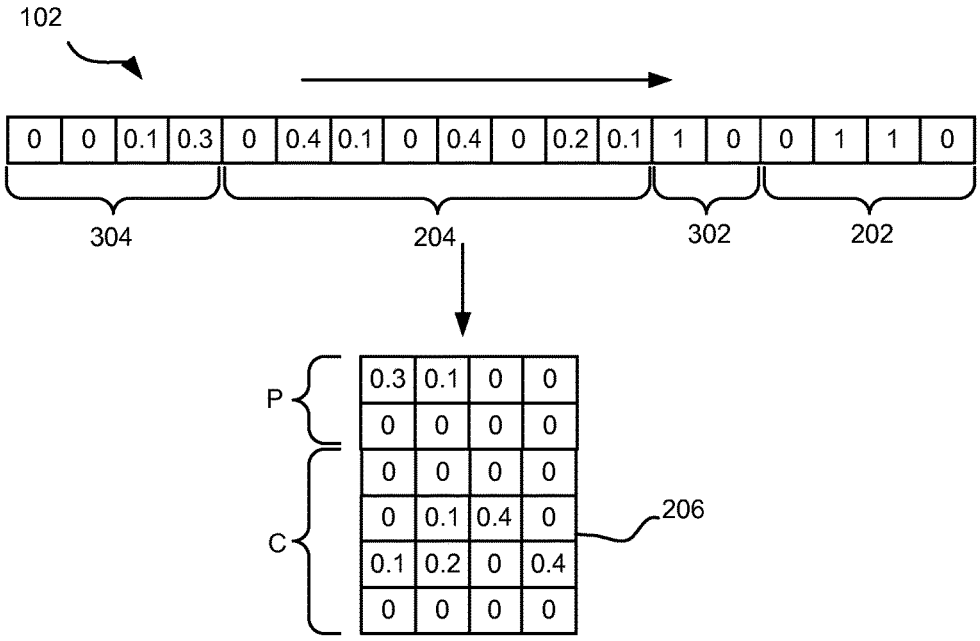

FIG. 3 describes decoding of an upmix matrix according to the first decoding mode, wherein decorrelated signals is used for reconstructing the audio object. The method for decoding the upmix matrix in FIG. 3 is the same as the one used and described in conjunction with FIG. 2 above, except that in FIG. 3, the bit stream 102 comprises second indicators 302 and second parameters 304 which are used for creating a part of the upmix matrix 206 denoted with P. This part P of the upmix matrix is then used by the reconstruction stage 112 for reconstructing the audio object. The reconstruction stage is according to this embodiment configured to, when reconstructing the audio object in the plurality of frequency band, add to the weighted sum of the downmix signals for a particular frequency band, a weighted sum of the decorrelated signals indicated by the second indicators for that particular frequency band, wherein each decorrelated signal 124 is weighted according to its associated second parameter. The specifics of the reconstruction are described above in conjunction with the equations (1) and (2).

Figure 4:
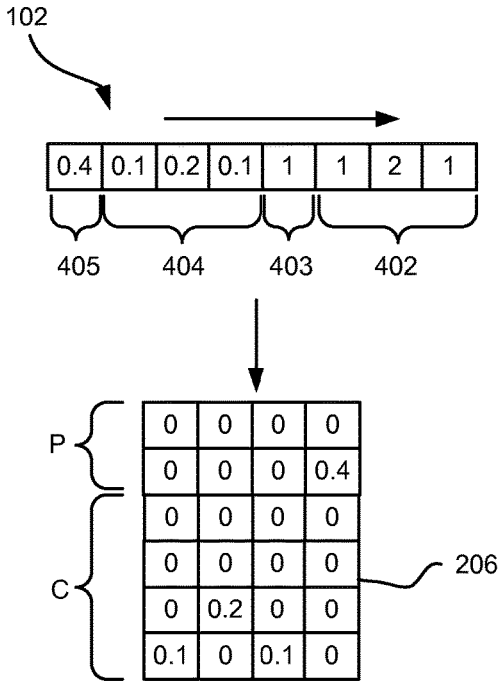

FIG. 4 describes decoding of an upmix matrix 206 according to a second decoding mode, where the columns correspond to frequency bands, the four lower rows correspond to downmix signals and the two upper rows corresponds to decorrelated signals. In FIG. 4, parts of the bit stream 102 is depicted. The bit stream is received by the encoder such the right most value in the bit stream is received first and the left most value is received last, also indicated by the arrow depicted above the representation of the bit stream 102. In the second decoding mode, the indicators 402, 403 for each frequency band indicate a single one of the M downmix signals or K decorrelated signals, if applicable, to be used in that frequency band when reconstructing the audio object. In FIG. 4, no decorrelated signals are used when reconstructing the audio object. The indicators 402, 403 may be received in the form of a vector of integers. Each element in the vector of integers may correspond to a frequency band and the index of the single downmix signal or decorrelated signal to be used for that frequency band. The parameters 404, 405 are thus each associated with a frequency band and the single downmix signal or decorrelated signal indicated by the indicators for that frequency band.

In FIG. 4, the first of the indicators 402, 403 is a first indicator and indicates that for the first frequency band (out of 4 in this example), the first of the M (M=4 in this example) downmix signals should be used. The corresponding parameter indicates that the weight when reconstructing the first frequency band of the reconstructed audio object from the first downmix signal should be 0.1. In the same way, the second indicator indicates that for the second frequency band, the second of the M downmix signals should be used. The corresponding parameter indicates that the weight when reconstructing the second frequency band of the reconstructed audio object from the second downmix signal should be 0.2. The same strategy is used for the third frequency band. The fourth indicator is a second indicator 403 and indicates that for the fourth frequency band, the first of the K (K=2 in this example) decorrelated signals should be used. The corresponding parameter is a second parameter 405 and indicates that the weight when reconstructing the fourth frequency band of the reconstructed audio object from the first decorrelated signal should be 0.4.

According to some embodiments, the bit stream 102 comprises a dedicated decoding mode parameter indicating which of the first decoding mode and the second decoding mode to be used. Further decoding modes may also be used. The dedicated decoding mode parameter may for example indicate that the full matrices C and P are included in the bit stream 102, i.e. the matrices are not sparsified at all. In this case the indicator data could be coded by a single indicator parameter (since the whole matrix is included in the bit stream). The decoding mode parameter may be advantageous in that it inform the decoder which sparsification strategy was used at the encoder side. Moreover, by including the decoding mode in the bit stream 102, the sparsification strategy may be changed from time frame to time frame, such that the encoder can choose the most advantageous strategy at all times.

According to some embodiment, the matrix multiplication (equation 2) for reconstructing the audio objects is only performed for the elements of the matrixes indicated as "active" or "used" by the indicators. This may allow for reducing the computational complexity of the decoder in the signal-processing part related to the implementation of equation (2), since multiplication with zero may be avoided. In other words, the indicators may help to keep track which parameters are actually used in any given time frequency-time slot, which allows for skipping computations for the dimensions (e.g. downmix signals and decorrelated signals, if applicable) that were sparsified. This may be done by constructing an indicator matrix, which for example may includes ones and zeros and be used as a filter when performing the matrix multiplications in equation (2). This may facilitate a decoder implementation where it is possible to go over a list of entries to perform elementary mathematical operations related to equation (2).

Moreover, by using the above strategy for performing the equation (2), a generic implementation of the reconstruction stage 112 of the decoder 100 may be facilitated. The reconstruction stage does not need to know which particular sparsification strategy was used at the encoder as long as the information in the bit stream 102 allows for construction of the indicator matrices. This means that the decoding scheme allows the use of whatever sparsification strategy that is used at the decoder, i.e., the coding complexity is outsourced to the encoder, which is typically advantageous.

Figure 8:
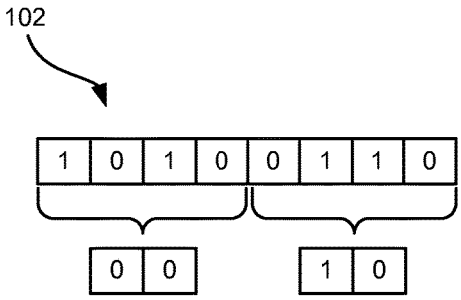

As can be seen in FIGS. 2-4, the indicators 202, 302 are received separately from the parameters 204, 304 in the bit stream 102. In the FIGS. 2-4, the indicators are received before the parameters but the other way around is equally possible. In other words, the indicators are not interleaved with the parameters. This is advantageous in that the indicators may be coded in the bit stream using a coding method which is not dependent on any coding method used for the parameters. For example, in the first decoding mode, the indicators 102 may be represented by a bit vector which in itself may be coded using entropy coding. This is depicted in FIG. 8, wherein the first four indicators are coded by '10' and the next four indicators are coded by '00'. The entropy coding may for example be Huffman coding. According to other embodiments, the indicators may be coded using multidimensional Huffman code. In this case, the Huffman code may be trained and optimized, for example, by generating indicators for a large database of representative material. The indicators can also be coded by means of a multidimensional Huffman code, where the binary symbols are grouped into binary vectors of a predefined length. Each such vector may be then encoded by a single Huffman codeword. For decoding the indicators, this may require that the full indicator matrix is reconstructed in the decoder for each time frame. In some embodiments, the entries of the indicator matrix can be grouped into multidimensional symbols according to above. The symbols can then be coded by means of some block-sorting compression (e.g., Burrows-Wheeler transform). An advantage of such a coding is that training is not necessary. It is also not necessary to transmit any additional information to the decoder.

According the embodiments, at least some of the received first parameters and second parameters, if applicable, are coded by means of time differential coding and/or frequency differential coding. In this case, the coding mode may be signalled in the bit stream. In the following, such coding of the parameters is further specified.

Differential coding of the parameters is utilized for more efficient coding by exploiting dependencies between different parameters in one or more dimensions, i.e. frequency-differential and/or time-differential coding. First-order differential coding is often a reasonable practical alternative. For all but the first value of a parameter, it is always possible to compute a difference between the current value of the parameter and the value of its previous occurrence. Similarly, one can always compute the difference between the quantization index related to the current parameter and the previous realization of the index. In the case of frequency differential coding, the coding scheme is operating along frequency axis (across frequency bands) and the previous occurrence of the parameter means one of the adjacent frequency bands, for example, the band associated with a lower frequency than the current band. In the case of the time differential coding, the previous parameter is associated with the previous "time slot" or frame, for instance, it may correspond to the same frequency band as the current parameter but to a previous "time slot" or frame. The differential coding needs to be initialized, since, as mentioned above, for the first parameter the previous values are not available. In this case one can use the differential coding for all but the first parameter. Alternatively, one can subtract from the first parameter its mean value. The same approach can also be used when differential coding operates on quantization indices, in which case one can subtract the mean value of the quantization index.

In some embodiments, both frequency-differential and time-differential coding is used and each parameter can be encoded by either of the two methods. The decision selection of the coding method is made by the encoder, typically by checking the resulting total codeword length (i.e., the sum of the lengths of the codewords that would be sent, the codewords being for example Huffman codewords) resulting from selecting a coding method and by selecting the most efficient alternative (i.e. the shortest total codeword length). So called I-frames are an exception, always forcing the use of frequency-differential coding. The makes sure that I-frames are always decodable, independent from whether the previous frame is available or not (similar to "Intra"-frames know in video coding). Typically, the encoder enforces I-frames in regular intervals, for example once per second.

Unlike typical channel-based parametric coding, each reconstructed object is (when not using sparsening) estimated from all available source channels (including downmix channels, possible decorrelator outputs, and possible auxiliary channels). This makes sending of parameters more expensive for object content. To alleviate this, it has been noted that since the two differential methods can vary quite arbitrarily in terms of efficiency, it is beneficial to make the choice between the two whenever possible, even if this produces much signalling bits. For the practical decoder implementation, this means using one signal bit per object for each source channel (i.e. downmix signal or decorrelated signal) where the object is reconstructed from. For example for 15 objects which all are reconstructed from 7 source channels, this would require 15*7=105 signalling bits.

In other words, according to one embodiment, a bit stream syntax construction is proposed, where the existence of the signalling bit determining the mode of the differential coding for a particular combination of an object and a downmix signal or a decorrelated signal is conditioned on the respective indicator in the indicator data, where the indicator indicates if a particular channel or decorrelated signal is used for reconstructing the object.

When sparse coding is utilized, the differential coding may become more complicated due to the fact that the notion of what is considered as the previous parameter is affected. There are instances, where the previous parameter is not available, because the sparse coding did not use the relevant dimensions in the previous frame. This situation is relevant whenever the sparsity indicator changes on a per frame basis or even on a per band basis (depending of which mode of sparsification is used). Also, the encoder selection between frequency-differential and time-differential requires a defined strategy of handling the sparsified dimensions. In a system that facilitates the sparsified coding, it is further beneficial to condition the signalling of the differential coding mode on the indicator data that indicates the sparsity. For example, the sparsified dimensions do not need to be associated with any additional signalling of the differential coding, which reduces the side-information bit rate.

There are many possible approaches to apply the differential coding in the context of sparse coding. The following example should not be construed as limiting but is provided as examples to allow the skilled person to exercise the invention.

According to one embodiment, a full matrix of the parameters based on the indicator data may always be reconstructed, and when employing differential coding, the zero valued parameters (or to the corresponding quantization indices) may be referred to. For example, in the context of the time-differential coding, for an object to be reconstructed, a relevant row of the matrix of parameters (or a matrix of quantization indices corresponding to these parameters) is constructed, where the missing dimensions are reconstructed from the indicator information. The full-dimensional vector of the parameter corresponding to the previous frame is then determined, which renders the differential coding. For instance, in this case, the dimensions that were sparsified in a previous frame are reconstructed by zeroes. Time differential coding may also refer to these dimensions.

Alternatively, according to some embodiments, in the case, where the parameters for the previous frame were sparsified, their values (only for the purpose of coding) may be reconstructed by taking the mean value of the respective parameter instead of zero (the mean value may be determined in a course of an off-line training, and then this value is used as a constant value in the encoder and decoder implementation). In this case, the change of the indicator data from an inactive state to the active state could mean that the parameter in previous frame should be assumed to be equal to the mean value of the parameter. In some cases, where the time differential coding is used, it may be beneficial to use the indicator data to reconstruct the sparsified parameters from the previous frame by using their mean values rather than zero in order to facilitate the coding of the current frame. In particular, in the case where modulo-differential coding is used, as described in the U.S. Provisional application No. 61/827,264 or subsequent applications claiming the priority of this application, for example in FIGS. 9 and 10 and by equation 11-13, this strategy may be beneficial and it may lead to some saving in bit-rate.

It may be noted that according to embodiments, the decoder may handle the coding of the upmix matrix according to what is described in the U.S. Provisional application No. 61/827,264 or subsequent applications claiming the priority of this application, for example in FIG. 13-15 and on page 29. This is from now on referred to as a third decoding mode. According to this embodiment, the decoder receives at least one encoded element representing a subset of M elements of a row in an upmix matrix, each encoded element comprising a value and a position in the row in the upmix matrix, the position indicating one of the M downmix signals to which the encoded element corresponds. The decoder is in this case configured for reconstructing the time/frequency tile of the audio object from the downmix signal by forming a linear combination of the downmix channels that correspond to the at least one encoded element, wherein in said linear combination each downmix channel is multiplied by the value of its corresponding encoded element. This means that the decoder according to embodiments may handle four decoding modes: decoding mode 1-3 and a mode where the full upmix matrix is included in the bit stream. The full upmix matrix may of course be coded in any suitable way.

Figure 5:
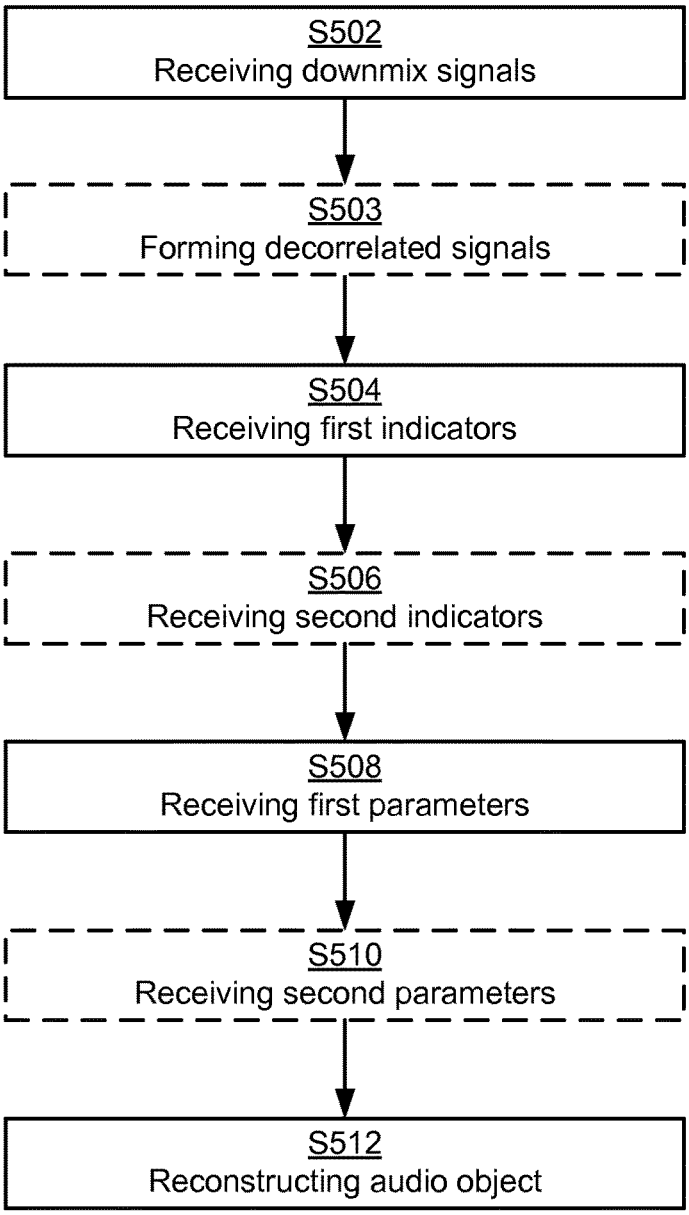

FIG. 5 describes by way of example a method for reconstructing an audio object in a time frame comprising a plurality of frequency bands. In a first step S502, M>1 downmix signals are received, wherein each is a combination of a plurality of audio objects including the audio object. The method further comprises a step S504 of receiving indicators comprising first indicators that indicate which of the M downmix signals to be used in the plurality of frequency bands when reconstructing the audio object. The method further comprises a step S508 of receiving first parameters each associated with a frequency band and a downmix signal indicated by the first indicators for that frequency band. Optionally, the method comprises a step S503 of forming K≥1 decorrelated signals (which may be based on the M downmix signals or any other received signals as explained above), wherein the indicators further comprising second indicators, received in step S506 which indicate which of the K decorrelated signals to be used in the plurality of frequency bands when reconstructing the audio object. In this case, the method further comprises the step S510 of receiving second parameters each associated with a frequency band and a decorrelated signal indicated by the second indicators for that frequency band. The final step S512 in the method depicted in FIG. 5 is the step of reconstructing the audio object in the plurality of frequency bands. This reconstruction is done by forming a weighted sum of at least the downmix signals indicated by the first indicators for that frequency band, wherein each downmix signal is weighted according to its associated first parameter. In the case the optional steps S503, S506, S510 pertaining to decorrelated signals were performed, the step S512 of reconstructing the audio object may further adding to the weighted sum of the downmix signals for a particular frequency band, a weighted sum of the decorrelated signals indicated by the second indicators for that particular frequency band, wherein each decorrelated signal is weighted according to its associated second parameter.

Figure 7:
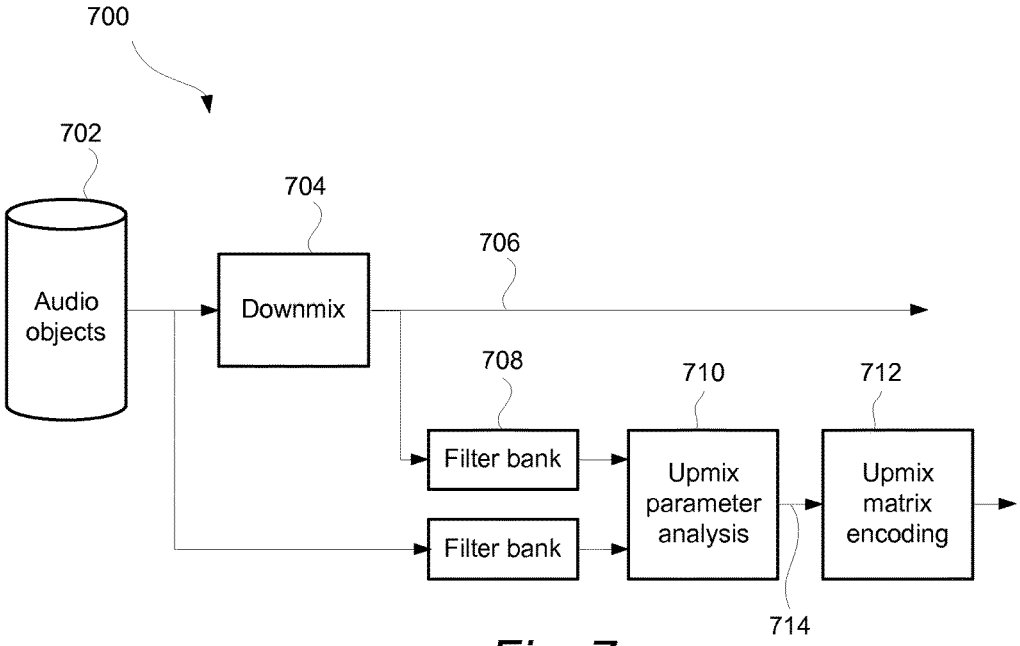
FIG. 7 is a generalized block diagram of an encoder for encoding an audio object in accordance with exemplary embodiments, FIG. 8 describes by way of example entropy coding of a vector of indicators.

FIG. 7, shows a generalized block diagram of an audio encoding system 700 for encoding audio objects 702. The audio encoding system comprises a downmixing component 704 which creates downmix signals 706 from the audio objects 104. The downmix signals 706 may for example be a 5.1 or 7.1 surround signals which is backwards compatible with established sound decoding systems such as Dolby Digital Plus or MPEG standards such as AAC, USAC or MP3. In further embodiments, the downmix signals are not backwards compatible.

To be able to reconstruct the audio objects 702 from the downmix signals 706, upmix parameters are determined at an upmix parameter analysis component 710 from the downmix signal 706 and the audio objects 702. For example the upmix parameters may correspond to elements of an upmix matrix which allows reconstruction of the audio objects 702 from the downmix signal 706. The upmix parameter analysis component 710 processes the downmix signal 706 and the audio objects 702 with respect to individual time/frequency tiles. Thus, the upmix parameters are determined for each time/frequency tile. For example, an upmix matrix may be determined for each time/frequency tile. For example, the upmix parameter analysis component 710 may operate in a frequency domain such as a Quadrature Mirror Filters (QMF) domain which allows frequency-selective processing. For this reason, the downmix signal 706 and the audio objects 702 may be transformed to the frequency domain by subjecting the downmix signal 706 and the audio objects 702 to a filter bank 708. This may for example be done by applying a QMF transform or any other suitable transform.

The upmix parameters 714 may be organized in a vector format. A vector may represent an upmix parameter for reconstructing a specific audio object from the audio objects 702 at different frequency bands at a specific time frame. For example, a vector may correspond to a certain matrix element in the upmix matrix, wherein the vector comprises the values of the certain matrix element for subsequent frequency bands. In further embodiments, the vector may represent upmix parameters for reconstructing a specific audio object from the audio objects 702 at different time frames at a specific frequency band. For example, a vector may correspond to a certain matrix element in the upmix matrix, wherein the vector comprises the values of the certain matrix element for subsequent time frames but at the same frequency band.

It may be noted that the encoder described in FIG. 7 does not comprise components for including decorrelation signals when determining the upmix matrix in the upmix parameter analysis component 710. However, the creation and use of decorrelated signals when determining an upmix matrix is a well known feature within the technical field, and is obvious for those skilled in the art. Moreover, it should be noted that the encoder may transmit bed channels as well, as described above.

The upmix parameters 714 are then received by an upmix matrix encoder 712 in the vector format. The upmix matrix encoder functions will now be described in conjunction with FIG. 6.

Figure 6:
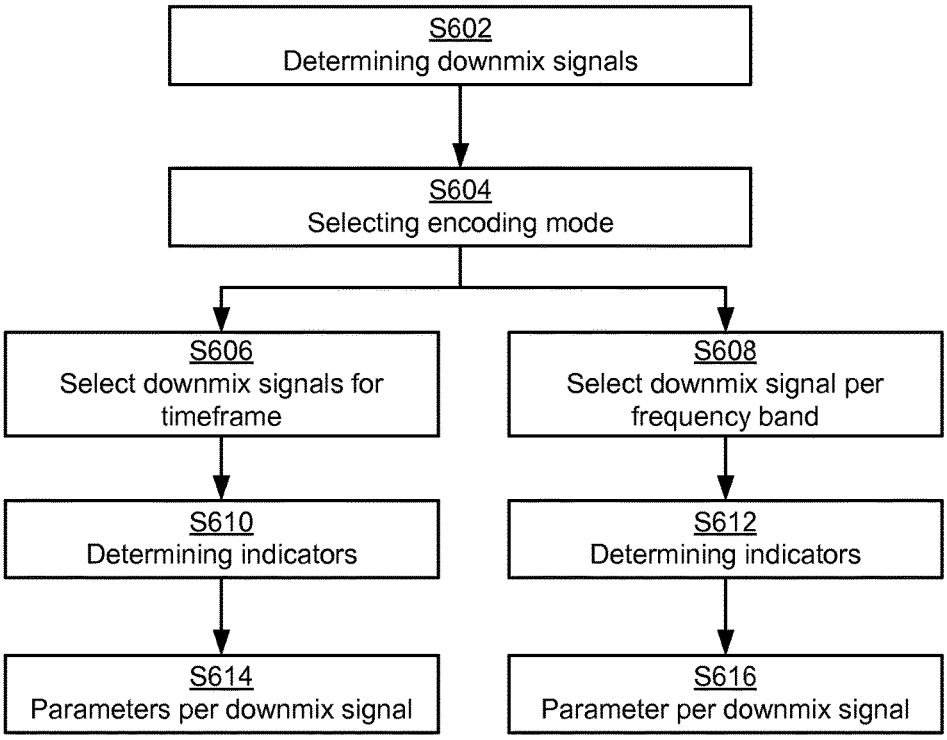

FIG. 6, describes method for encoding an audio object in a time frame comprising a plurality of frequency bands, the method having a first and a second encoding mode. The method starts by determining S602 M>1 downmix signals, each being a combination of a plurality of audio objects including the audio object. Subsequently, the encoding mode, or sparsification strategy, is selected S604. The encoding mode determines how the upmix matrix, for reconstructing the audio objects from the downmix signals, should be represented (e.g., sparsified) and then accordingly encoded. In general there are several possible encoding modes that can be used at the encoder for encoding the upmix matrix. However, it has been determined by means of experiments that a first encoding mode, as explained below and above in conjunction with the decoder (the first encoding mode corresponds to the first decoding mode in the decoder), can often be advantageous in terms of addressing the rate-distortion trade-off for the coded signals. If the first decoding mode is selected, the method further comprises the step of selecting S606 a subset of the M downmix signals to be used when reconstructing the audio object in a decoder in an audio coding system. The method further comprising representing S610 each downmix signal in the subset of the M downmix signals by an indicator identifying the downmix signal among the M downmix signals. The final step of the first encoder mode branch of the method described in FIG. 6 is representing S614 each downmix signal by a plurality of parameters, one for each of the plurality of frequency bands, and each one associated with a frequency band, wherein each parameter of the plurality of parameters represents a weight for the decorrelated signal when reconstructing the audio object for the associated frequency band.

The first encoding mode may thus be defined as a broad-band sparsification meaning that each indicated downmix signal to be used when reconstructing a timeframe of an audio object is used for all frequency bands of the time frame of the audio object. The number of indicators that has to be transmitted may thus be reduced since only one indicator is transmitted for all frequency bands for each indicated downmix signal. Moreover it has been noted that a specific downmix signal in many cases is advantageously used for reconstructing all frequency bands of a time frame of an audio object, leading to a reduced distortion of the reconstructed audio object.

In the following it is assumed that there are N original audio signals x which can be either objects or channels.

$$x_n(t), n=1, \ldots, N,$$

It is also assumed that decorrelated signals may be used for reconstructing the audio objects.

The original signals is considered as row vectors and collected in matrix X. The n-th object within the reconstructed version of X is denoted by $\hat{x}_n$. A single time-frequency slot of the representation of $\hat{x}_n$ is denoted by $\hat{x}_n(t,f)$. The decoder has access to the full down-mix signal $Y=[y_1, \ldots, y_M]^T$ and the decorrelated signals $Z=[z_1, \ldots, z_K]^T$. Let us assume that the indicator information for the downmix signal part of the model given by equation (2) is given by a binary vector $I_c$ and $I_p$ is the indicator information for the decorrelated part. A set of integers corresponding to non-zero positions in I, is defined and denote the set by $S_c$. Similarly, for $I_p$, we define the set $S_p$. The reconstruction of $\hat{x}_n(t,f)$ is obtained by $$\hat{x}_n(t,f)=\Sigma_{m\in S_c} c_{nm} y_m(t,f)+\Sigma_{k\in S_p} p_{nk} z_k(t,f) \quad \text{equation (3)}$$

Note that while synthesis described in equation (3) is performed on a per frequency band basis, the sets $S_c$ and $S_p$ are constructed in a broad-band manner as defined above. Further, note that the matrices C (upmix matrix for downmix signals) and P (upmix matrix for decorrelated signals) are defined as described in conjunction with the decoder.

There are several practical approaches at the encoder that are able to utilize the broad-band sparse coding (i.e. the first encoding mode). They are outside the scope of this invention. Nevertheless, we disclose some practical examples for the sake of clarity of the description. For example, the broad-band sparsification strategy can be implemented at the decoder using a so-called two-pass approach. In the first pass the encoder would estimate the full non-sparse parameter matrices according to equation (2) performing the analysis in the individual sub-bands. In the next step, the encoded may analyze the parameters by concatenating the observations from the individual sub-bands. For example, a cumulative sum of the absolute value of the parameter may be computed yielding a matrix of size [number of objects]×[number of down-mix channels]. By means of thresholding, it is possible to convert the matrix into a broad-band indicator matrix, where the small values can be set to 0 and values larger than the threshold can be set to 1. The indicator matrix can be used by the second pass of the encoder, where the model parameters specified by equation (2) are updated according to the broad-band indicator matrix by using only selected dimensions of Y in the analysis.

In addition to the two-pass approach, one may use a matching pursuit algorithm that operates with a constraint on the number of downmix or decorrelated dimensions kept for the prediction of a particular object (i.e., a number of downmix signals and a number of decorrelated signals).

There are several ways to convert the indicator information into the actual bit stream. Since the indicator matrix already contains binary data, it can be simply converted into a sequence of bits by agreeing upon the convention. For example, a two dimensional binary matrix can be arranged into a one dimensional bit stream by using the major-column order or the major-row order. Once the decoder knows the convention, it is able to perform the decoding. The parameters may be encoded using for example entropy coding (e.g. Huffman code). Any type of multi dimensional coding, as explained in conjunction with the decoder above, are possible for both the indicators and the parameters.

According to embodiments, in the step of selecting an encoding mode S604, a second decoding mode may be selected. In this case, the method further comprising the step of selecting S608 a single one of the M downmix signals (or K decorrelated signals). The selected signal is represented S612 by an indicator identifying the selected signal among the M downmix signals (and K decorrelated signals). The selected signal is further represented S616 by a parameter representing a weight for the selected signal when reconstructing the audio object for the frequency band. The second encoding mode may for example be implemented by an matching pursuit algorithm that operates with a constraint on the number of downmix or decorrelated dimensions kept for the prediction of a particular object, in the case of the second encoding mode, the number is one.

In the second encoding mode, the sparsity is imposed on a per band basis. In this case, an individual band of an object is predicted using only a single downmix signal or decorrelated signal. The indicator data comprises therefore a single index per band, which indicates the downmix signal or decorrelated signal that is used to reconstruct the frequency band of the audio object. The indicator data can be encoded as an integer or as a binary flag. The parameters may be encoded using for example entropy coding (e.g. Huffman code). This second encoding mode leads to a significant reduction of the bit-rate as, for example, for each band of each object, there is only a single parameter that needs to be transmitted.

According to embodiments, the indicators identifying downmix signals or decorrelated signals, if applicable, are included in a data stream for transmittal to the decoder separately from the parameters representing weights for the decorrelated signal or decorrelated signals, if applicable. This may be advantageous in that different coding may be used for the indicators and the parameters.

According to embodiments, the used encoding mode is indicated by a decoding mode parameter included in a data stream for transmittal to the decoder.

EQUIVALENTS, EXTENSIONS, ALTERNATIVES AND MISCELLANEOUS

Further embodiments of the present disclosure will become apparent to a person skilled in the art after studying the description above. Even though the present description and drawings disclose embodiments and examples, the disclosure is not restricted to these specific examples. Numerous modifications and variations can be made without departing from the scope of the present disclosure, which is defined by the accompanying claims. Any reference signs appearing in the claims are not to be understood as limiting their scope.

Additionally, variations to the disclosed embodiments can be understood and effected by the skilled person in practicing the disclosure, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The systems and methods disclosed hereinabove may be implemented as software, firmware, hardware or a combination thereof. In a hardware implementation, the division of tasks between functional units referred to in the above description does not necessarily correspond to the division into physical units; to the contrary, one physical component may have multiple functionalities, and one task may be carried out by several physical components in cooperation. Certain components or all components may be implemented as software executed by a digital signal processor or microprocessor, or be implemented as hardware or as an application-specific integrated circuit. Such software may be distributed on computer readable media, which may comprise computer storage media (or non-transitory media) and communication media (or transitory media). As is well known to a person skilled in the art, the term computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. Further, it is well known to the skilled person that communication media typically embodies computer readable instructions, data structures, program modules or other data in a modulated data signal such as a carrier wave or other transport mechanism and includes any information delivery media.

The invention claimed is:

1. A method of reconstructing an audio object of a time frame comprising a plurality of frequency bands, comprising:

receiving M>1 downmix signals, each being a combination of a plurality of audio objects including the audio object, wherein the M>1 downmix signals are output by a parametric encoder and are used for reconstructing the audio object, receiving a bitstream that includes indicators comprising first indicators that indicate which N of the M downmix signals to be used and not to be used in the plurality of frequency bands when reconstructing the audio object, wherein N is less than or equal to M wherein, in a first decoding mode, each of the first indicators indicates a downmix signal to be used for all of the plurality of frequency bands when reconstructing the audio object, receiving first parameters each associated with a frequency band and a downmix signal indicated by the first indicators for that frequency band, wherein receiving the first parameters includes parsing the first parameters from the bitstream based on positions of the first indicators in the bitstream and parsing a parameter indicating a number of frequency bands in the plurality of frequency bands reconstructing the audio object of the plurality of frequency bands by, for each frequency band of the plurality of frequency bands, forming a weighted sum of at least the downmix signals indicated by the first indicators for the frequency band, wherein each downmix signal is weighted according to its associated first parameter.

2. The method of claim 1, further comprising:

forming K≥1 decorrelated signals, wherein the indicators further comprising second indicators which indicate which of the K decorrelated signals to be used in the plurality of frequency bands when reconstructing the audio object, wherein, in the first decoding mode, each of the second indicators indicates a decorrelated signal to be used for all of the plurality of frequency bands when reconstructing the audio object, receiving second parameters each associated with a frequency band and a decorrelated signal indicated by the second indicators for that frequency band, wherein the step of reconstructing the audio object in the plurality of frequency band further comprises adding to the weighted sum of the downmix signals for a particular frequency band, a weighted sum of the decorrelated signals indicated by the second indicators for that particular frequency band, wherein each decorrelated signal is weighted according to its associated second parameter.

3. The method according to claim 1, wherein the indicators are received in the form of a binary vector, each element of the binary vector corresponding to one of the M downmix signals.

4. The method according to claim 2, wherein the indicators are received in the form of a binary vector, each element of the binary vector corresponding to one of the M downmix signals or to one of the K decorrelated signals.

5. The method of claim 3, wherein the received binary vector is coded by entropy coding.

6. The method of claim 1, wherein, in a second decoding mode, the indicators for each frequency band indicate a single one of the M downmix signals to be used in that frequency band when reconstructing the audio object.

7. The method of claim 2, wherein, in a second decoding mode, the indicators for each frequency band indicate a single one of the M downmix signals or a single one of the K decorrelated signals to be used in that frequency band when reconstructing the audio object.

8. The method according to claim 6, wherein the indicators are received in the form of a vector of integers, wherein each element in the vector of integers corresponds to a frequency band and the index of the single downmix signal to be used for that frequency band.

9. The method of claim 8, wherein the received integer vector is coded by entropy coding.

10. The method of claim 6 further comprising:

receiving a decoding mode parameter indicating which of the first decoding mode and the second decoding mode to be used.

11. The method of claim 1, wherein the indicators are received separately from the parameters.

12. The method of claim 1, wherein at least some of the received first parameters are coded by means of time differential coding and/or frequency differential coding.

13. The method according to claim 2, wherein at least some of the received second parameters are coded by means of time differential coding and/or frequency differential coding.

14. The method of claim 1, wherein the first parameters are coded by means of entropy coding.

15. The method according to claim 2, wherein the second parameters are coded by means of entropy coding.

16. A computer program product comprising a non-transitory computer-readable medium with instructions for performing the method of claim 1.

17. A decoder for reconstructing an audio object of a time frame comprising a plurality of frequency bands, comprising:

a receiving stage configured for:

receiving M>1 downmix signals, each being a combination of a plurality of audio objects including the audio object, wherein the M>1 downmix signals are output by a parametric encoder and are used for reconstructing the audio object, receiving a bitstream including indicators comprising first indicators that indicate which of the M downmix signals to be used and not to be used in the plurality of frequency bands when reconstructing the audio object, wherein, in a first decoding mode, each of the first indicators indicates a downmix signal to be used for all of the plurality of frequency bands when reconstructing the audio object, and receiving first parameters each associated with a frequency band and a downmix signal indicated by the indicators for that frequency band, wherein receiving the first parameters includes parsing the first parameters from the bitstream based on positions of the first indicators in the bitstream and parsing a parameter indicating a number of frequency bands in the plurality of frequency bands, a reconstruction stage configured for reconstructing the audio object of the plurality of frequency bands by, for each frequency band of the plurality of frequency bands, forming a weighted sum of the downmix signals indicated by the first indicators for the frequency band, wherein each downmix signal is weighted according to its associated first parameter.

18. A method for encoding an audio object of a time frame comprising a plurality of frequency bands, comprising:

determining M>1 downmix signals, each being a combination of a plurality of audio objects including the audio object, wherein the M>1 downmix signals are output by a parametric encoder and are used for reconstructing the audio object, in a first encoding mode, selecting a subset comprising N downmix signals of the M downmix signals to be used when reconstructing the audio object in a decoder in an audio coding system, wherein N is less than or equal to M, and representing each downmix signal in the subset of the M downmix signals by an indicator identifying the downmix signal to be used and not to be used among the M downmix signals, and by a plurality of parameters, one for each of the plurality of frequency bands, and each one associated with a frequency band, wherein each parameter of the plurality of parameters represents a weight for the downmix signal when reconstructing the audio object for the associated frequency band, and generating an encoded bitstream including the indicators for each downmix signal in the subset of the M downmix signals and the plurality of parameters, wherein a position of each parameter in the bitstream is based on a position of its corresponding indicator in the bitstream and a parameter indicating a number of frequency bands in the plurality of frequency bands.

19. The method according to claim 18, further comprising:

forming K≥1 decorrelated signals, in the first encoding mode selecting a subset of the K decorrelated signals to be used when reconstructing the audio object in a decoder in an audio coding system, representing each decorrelated signal in the subset of the K decorrelated signals by an indicator identifying the decorrelated signal among the K decorrelated signals, and by a plurality of parameters, one for each of the plurality of frequency bands, and each one associated with a frequency band, wherein each parameter of the plurality of parameters represents a weight for the decorrelated signal when reconstructing the audio object for the associated frequency band.

20. The method of claim 18, wherein in a second encoding mode, for each of the plurality of frequency bands, selecting a single one of the M downmix signals and representing the selected signal by an indicator identifying the selected signal among the M downmix signals and by and a parameter representing a weight for the selected signal when reconstructing the audio object for the frequency band.

* * * * *